US005896159A

United States Patent [19]

Masubuchi et al.

[11] Patent Number: 5,896,159

[45] Date of Patent: Apr. 20, 1999

[54] TEMPERATURE CONTROLLING METHOD AND APPARATUS FOR A THERMAL PRINTHEAD

[75] Inventors: Fumihito Masubuchi, Shizuoka-ken; Akira Suzuki, Mishima, both of Japan

[73] Assignee: Ricoh Company, Ltd., Tokyo, Japan

[21] Appl. No.: 08/745,626

[22] Filed: Nov. 8, 1996

[30] Foreign Application Priority Data

Nov. 10, 1995 [JP] Japan ..... 7-315882

[51] Int. Cl.[6] ..... B41J 2/32

[52] U.S. Cl. ..... 347/194; 347/191; 400/120.11

[58] Field of Search ..... 347/171, 179, 347/191, 194, 224, 232; 400/120.11

[56] References Cited

U.S. PATENT DOCUMENTS 5,321,239 6/1994 Masubuchi et al. ..... 235/380
5,371,522 12/1994 Miyawaki et al. ..... 347/224
5,379,058 1/1995 Obu et al. ..... 347/232
5,448,065 9/1995 Masubuchi et al. ..... 250/316.1
5,453,765 9/1995 Yamaguchi et al. ..... 347/179
5,538,822 7/1996 Itoda et al. ..... 430/19
5,691,758 11/1997 Kamada et al. ..... 347/171

*Primary Examiner*—N. Le
*Assistant Examiner*—Anh T. N. Vo
*Attorney, Agent, or Firm*—Oblon, Spivak, McClelland, Maier & Neustadt, P.C.

[57] ABSTRACT

A temperature controlling method and apparatus for a thermal printhead, in which a temperature of a thermosensitive recording material is detected by measuring a temperature change of the thermal printhead when a surface of the thermosensitive recording material contacts a surface of the resistant heater of the thermal printhead. The thermosensitive recording material is heated by the thermal printhead to a temperature suitable for recording or erasing an image on the thermosensitive recording material, with the temperature suitable for recording or erasing the image being changed as a function of the detected temperature of the thermosensitive recording material.

29 Claims, 6 Drawing Sheets

TEMPERATURE CONTROLLING METHOD AND APPARATUS FOR A THERMAL PRINTHEAD

BACKGROUND OF THE INVENTION

1. Field of the Invention

The present invention relates to a temperature controlling method and apparatus for a thermal printhead useful for thermal recording of an image on reversible thermosensitive recording materials or normal thermosensitive recording materials, and more particularly to a method and apparatus for controlling a temperature of a thermal printhead to a temperature suitable for erasing and recording an image under various temperature conditions.

The present invention is based on Japanese Patent Application No. 07-315882 filed on Nov. 10, 1995 incorporated herein by reference.

2. Discussion of Background

A reversible thermosensitive recording material is well known and has wide-scale utilization not only as a recording material for facsimile machines, computers and word processors, but also as a material for cards, such as a prepaid card on which an image is recorded on a predetermined area. In particular, since a reversible thermosensitive recording material can have image information repeatedly erased from it and printed on it, cards utilizing such a reversible thermosensitive recording material can be used repeatedly.

A reversible thermosensitive recording material is disclosed in, for example, Japanese Laid-Open Patent Application No. 4-44887. Such a reversible thermosensitive recording material reversibly changes transparency upon application of proper heat thereto and accordingly can be used to repeatedly print and erase image information on it. As shown in FIG. 1, a reversible thermosensitive recording material 1 has a substrate 41 such as polyester film, a recording layer 44 which is formed on the substrate 41, and a recording material including a complex of a polymer 42 and a low-molecular-weight organic compound 43. Particles of the low-molecular-weight organic compound 43 are dispersed in the polymer 42, and a protective layer 45 is formed on the recording layer 44. As shown in FIG. 2, transparency of the recording material of the recording layer 44 changes when the recording material is heated or cooled. For example, when the recording material in an opaque state below room temperature $T_1$ (i.e., state A) is heated, transparency of the recording material begins to increase at a temperature of $T_2$ and reaches a maximum transparent state B at a temperature $T_3$. If the recording material in a maximum transparent state B is cooled to room temperature (i.e., to state C), transparency of the recording material is maintained. If the recording material which is in the maximum transparent state C is heated to a temperature $T_4$, higher than the temperature $T_3$ the recording material reaches an intermediate state (i.e., state D) between the maximum transparent state B and the maximum opaque state A, as shown by a dotted line CD in FIG. 2. As the recording material in the intermediate state D is cooled to below room temperature $T_1$, the recording material returns to the maximum opaque state (i.e., state A), as shown by a dotted line DA in FIG. 2. The reversible thermosensitive recording material 1 has a property of reversibly changing transparency when a particle of the low-molecular-weight organic compound 43 changes between a single crystal state and a polycrystalline state upon application of heat. When a particle of the low-molecular-weight organic compound 43 in the recording material 1 is in the single crystal state, the particle transmits light and accordingly the recording material 1 appears transparent. On the other hand, when the particle is in the polycrystalline state, the particle scatters light and accordingly the recording material appears opaque. By using this property of the particles of the low-molecular-weight organic compound 43, the recording material 1 can be used to repeatedly record and erase image information.

Japanese Laid-Open Patent Application No. 5-4446 discloses an apparatus which repeatedly records and erases image information on the reversible thermosensitive recording material 1. As shown in FIG. 3, the apparatus has an image erasing thermal printhead 6 and an image recording thermal printhead 5. When the reversible thermosensitive recording material 1, fed by a feeding roller 3 and platen rollers 4, is detected by a position detecting sensor 46 which is placed before the image erasing thermal printhead 6, the image erasing thermal printhead is heated and kept at a temperature which makes the reversible thermosensitive recording material 1 transparent, thus erasing previously recorded opaque image information. Then the image recording thermal printhead 5 records new opaque image information on the transparent recording layer of the reversible thermosensitive recording material 1. By repeating the above operations, the reversible thermosensitive recording material 1 can be repeatedly used.

However, when a thermosensitive recording material is used for a card, such a prepaid card, often times a card which has been exposed to the outside air is inserted into a recording device having a thermal printhead for recording or erasing. In such a case, a temperature of the card, i.e., a temperature of a thermosensitive recording material in the card, may happen to be below 0° C. or conversely more than 50° C. In the above cases, if a constant heat quantity suitable for the recording or erasing of image information on the thermosensitive recording materials exposed to a normal temperature is applied to a card having a temperature which is below 0° C. or above 50° C., problems such as unsatisfactory image erasing or image recording tend to occur because the heat quantity is not suitable to erase or record image information on such a card.

In particular, when previously recorded image information on a recording layer of a reversible thermosensitive recording material is erased and then new image information is again recorded on the recording layer, or when an image having several different degrees of transparency is recorded on a recording layer of a reversible thermosensitive recording material, heat that is applied to the recording layer of the reversible thermosensitive recording material has to be strictly controlled to perform image erasing and recording. If heat applied to the recording layer in the reversible thermosensitive recording material to erase or record image information is not strictly controlled, the recording quality of a recorded image is degraded. In addition, when an image is recorded on a thin card such as a prepaid card or a thick card such as a credit card with the above image erasing and recording apparatus, the recording quality of recorded images on the thick card tends to be degraded, particularly in relatively low temperature environments because of insufficient transfer of heat for image recording or image erasing due to the thickness of the card.

Because of the above reasons, a need exists for a thermal recording method and an apparatus which can erase previously recorded image information and/or record image information on a reversible thermosensitive recording material regardless of a temperature of the recording material before the image erasing or recording operation.

SUMMARY OF THE INVENTION

Accordingly, one object of the present invention is to provide a thermal recording method in which a previously recorded image can be erased and/or a new image can be recorded on a thermosensitive recording material, regardless of a temperature of the recording material before the image recording or erasing operation.

Another object of the present invention is to provide a thermal recording apparatus which can erase a previously recorded image and/or record a new image on a thermosensitive recording material, regardless of a temperature of the recording material before the image erasing or recording operation.

The above and other objects are achieved according the present invention by providing a novel temperature controlling method for a thermal printhead used for recording or erasing an image on a thermosensitive recording material, including the steps of:

(1) heating a resistant heater of said thermal printhead to a constant temperature by applying a current to said resistant heater of said thermal printhead;

(2) measuring a temperature change of said resistant heater of said thermal printhead at a time when a surface of said resistant heater of said thermal printhead contacts a surface of said thermosensitive recording material;

(3) determining a temperature of said thermosensitive recording material as a function of a predefined relationship between a temperature of said thermosensitive recording material and a temperature change of said resistant heater of said thermal printhead;

(4) determining a heating temperature of said resistant heater of said thermal printhead as a function of the temperature of said thermosensitive recording material; and (5) applying a current to said resistant heater of said thermal printhead to heat said resistant heater to the heating temperature.

According to a second aspect of the present invention, there is provided a novel temperature controlling method for a thermal printhead used for recording or erasing an image on a thermosensitive recording material, including the steps of:

(1) heating a resistant heater of said thermal printhead to a constant temperature by applying a current to said resistant heater of said thermal printhead;

(2) measuring a temperature change of said resistant heater of said thermal printhead at a time when a surface of said resistant heater of said thermal printhead for a constant time contacts a surface of said thermosensitive recording material;

(3) determining a temperature of said thermosensitive recording material as a function of a predefined relationship between a temperature of said thermosensitive recording material and a temperature change of said resistant heater of said thermal printhead;

(4) determining a heating temperature of said resistant heater of said thermal printhead as a function of the temperature of said thermosensitive recording material; and (5) applying a current to said resistant heater of said thermal printhead to heat said resistant heater to the heating temperature.

According to a third aspect of the present invention, there is provided a novel temperature controlling method for a thermal printhead used for recording or erasing an image on a thermosensitive recording material, including the steps of:

(1) bringing a surface of a resistant heater of said thermal printhead into contact with a surface of said thermosensitive recording material;

(2) applying a current to said resistant heater of said thermal printhead so that said resistant heater generates a constant heat quantity;

(3) measuring a temperature change of said resistant heater of said thermal printhead;

(4) determining a temperature of said thermosensitive recording material as a function of a predefined relationship between a temperature of said thermosensitive recording material and a temperature change of said resistant heater of said thermal printhead;

(5) determining a heating temperature of said resistant heater of said thermal printhead as a function of the temperature of said thermosensitive recording material; and (6) applying a current to said resistant heater of said thermal printhead to heat said resistant heater to the heating temperature.

According to a fourth aspect of the present invention, there is provided a novel temperature controlling apparatus for a thermal printhead having a resistant heater used for recording or erasing an image on a thermosensitive recording material, including:

(1) a printhead temperature measuring element which measures a temperature of said resistant heater of said thermal printhead;

(2) a temperature change detecting element which detects a temperature change of said resistant heater of said thermal printhead;

(3) a thermal characteristics storage element which stores a first predefined relationship between a temperature of said thermosensitive recording material and a temperature change of said resistant heater of said thermal printhead at a time when a surface of said resistant heater of said thermal printhead contacts a surface of said thermosensitive recording material, and stores a second predefined relationship between a temperature of said thermosensitive recording material and a heating temperature of said resistant heater of said thermal printhead to record or erase an image on said thermosensitive recording material;

(4) a material temperature determining element which determines a temperature of said thermosensitive recording material as a function of the first predefined relationship stored in said thermal characteristics storage element; and (5) a printhead temperature controlling element which sets a temperature of said resistant heater of said thermal printhead to a heating temperature which is determined as a function of the second predefined relationship stored in said thermal characteristics storage element.

According to a fifth aspect of the present invention, the above-mentioned printhead temperature measuring element determines a temperature of the resistant heater of the thermal printhead by measuring resistance of the resistant heater.

These and other objects, features and advantages of the present invention will become apparent upon a consideration of the following description of the preferred embodiments of the present invention taken in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed descriptions when considered in connection with the accompanying drawings, wherein.

DESCRIPTION OF THE PREFERRED EMBODIMENTS

Figure 4:
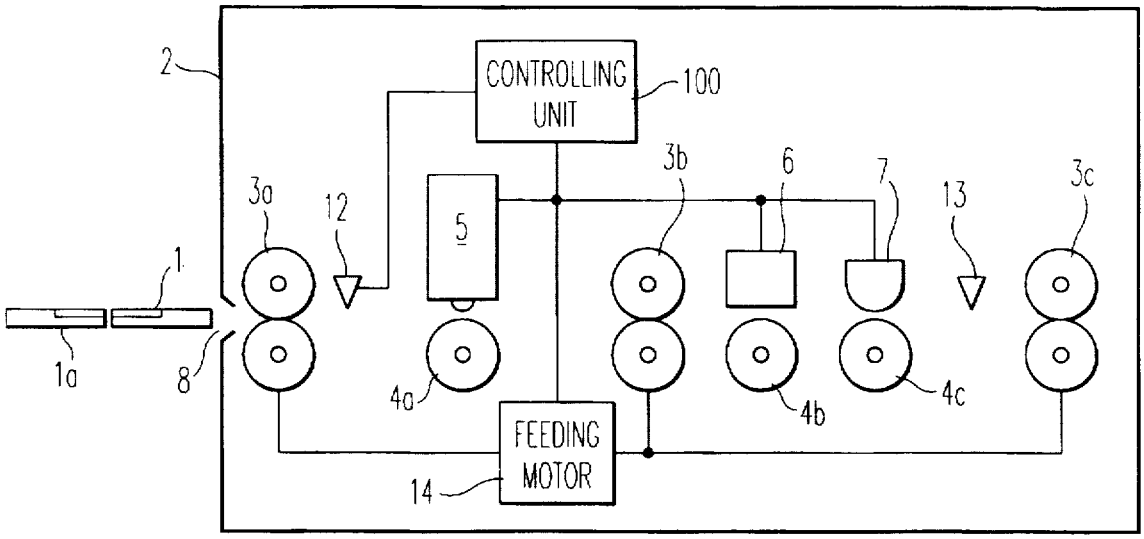
FIG. 4 is a schematic diagram of a thermal recording and erasing apparatus according to the present invention.

Referring now to the drawings, wherein like reference numerals designate identical or corresponding parts throughout the several views, and more particularly to FIG. 4 thereof, which shows a schematic diagram of a thermal recording and erasing apparatus according to the present invention.

Figure 5:
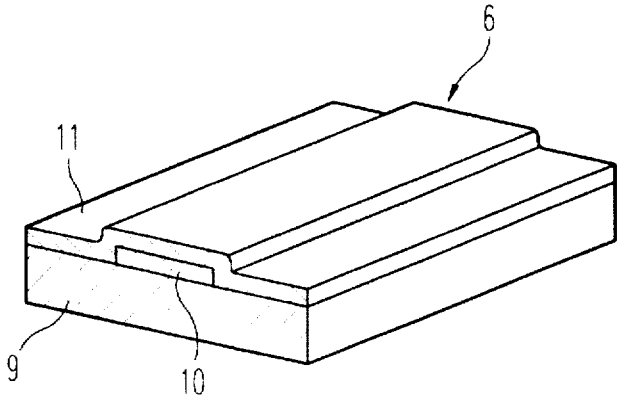
FIG. 5 is a sectional view of an image erasing thermal printhead of the thermal recording and erasing apparatus shown in FIG. 4.

In FIG. 4, a thermal recording and erasing apparatus 2 according to the present invention can repeatedly record and erase image information on a card 1*a* having a reversible thermosensitive recording material 1 (hereinafter referred to as recording material 1). The thermal erasing and recording apparatus 2 also includes an image recording thermal printhead 5 (hereinafter referred to as a thermal printhead 5) for recording an image, an image erasing thermal printhead 6 (hereinafter referred to as a thermal erasing head 6) for erasing an image, a magnetic head 7 for reading magnetic information, controlling unit 100, and feeding motor 14. The card 1*a* is inserted into entrance 8 and is fed along a card feeding path which includes plural feeding rollers 3*a*, 3*b* and 3*c*, and platen rollers 4*a*, 4*b* and 4*c*. The thermal printhead 5 records an image on the recording material 1. As shown in FIG. 5, the thermal erasing head 6 includes, for example, a belt shaped resistant heater 10 which is 2 mm wide and 20 μm thick and which is formed on, for example, a ceramic substrate 9 which is 1 mm thick, and a protective layer 11 of, for example, crystallized glass covering the resistant heater 10. The thermal erasing head 6 is set on the card feeding path so that the belt shaped resistant heater 10 is perpendicular to the card feeding path. The thermal erase head 6 erases an image on the recording material 1 by bringing a heated surface of the protective layer 11 which is heated to a constant temperature into contact with the recording material 1. A predetermined pulse current is applied to the resistant heater 10 to heat the surface of the protective layer 11 to a constant temperature suitable for erasing an image on the recording material 1 (hereinafter a surface of a protective layer 11 is referred to as a surface of a resistant heater 10). A first position detecting sensor 12 is provided after the feeding roller 3*a* and a second position detecting sensor 13 which detects a tip edge of the card 1*a* is provided before the innermost feeding roller 3*c* which reversely feeds the card 1*a*.

Figure 6:
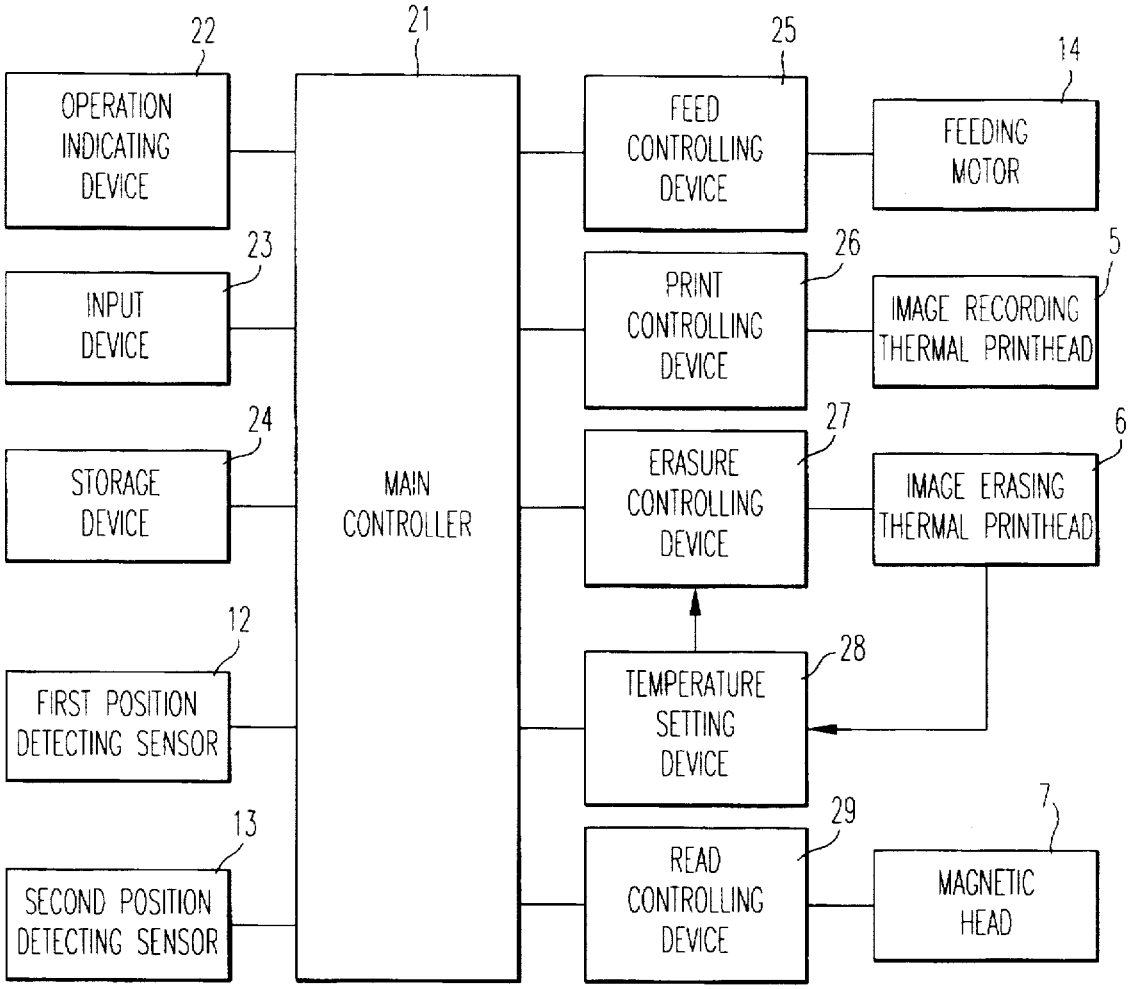
FIG. 6 is a block diagram of a controlling unit of the thermal recording and erasing apparatus shown in FIG. 4.

As shown in FIG. 6, a controlling unit 100 of the thermal recording and erasing apparatus 2 includes a main controller 21 which controls all operations of the apparatus, an operation indicating device 22, an input device 23, a storage device 24, a feed controlling device 25, a print controlling device 26, an erasure controlling device 27, a temperature setting device 28 and a read controlling device 29. The input device 23 inputs information to be recorded in the recording material 1 to the storage device 24 which stores the information. The feed controlling device 25 controls clockwise or counterclockwise rotation of a feeding motor 14 to drive plural feeding rollers 3*a*, 3*b* and 3*c*. The print controlling device 26 controls an operation of the thermal printhead 5. The erasure controlling device 27 controls a current to be applied to the resistant heater 10 of the thermal erasing head 6 to control a temperature of the resistant heater 10. The temperature setting device 28 sets a heating temperature of the resistant heater 10 of the thermal erasing head 6 which is determined depending on a temperature of the card 1*a*. The read controlling device 29 controls an operation of the magnetic head 7.

Figure 7:
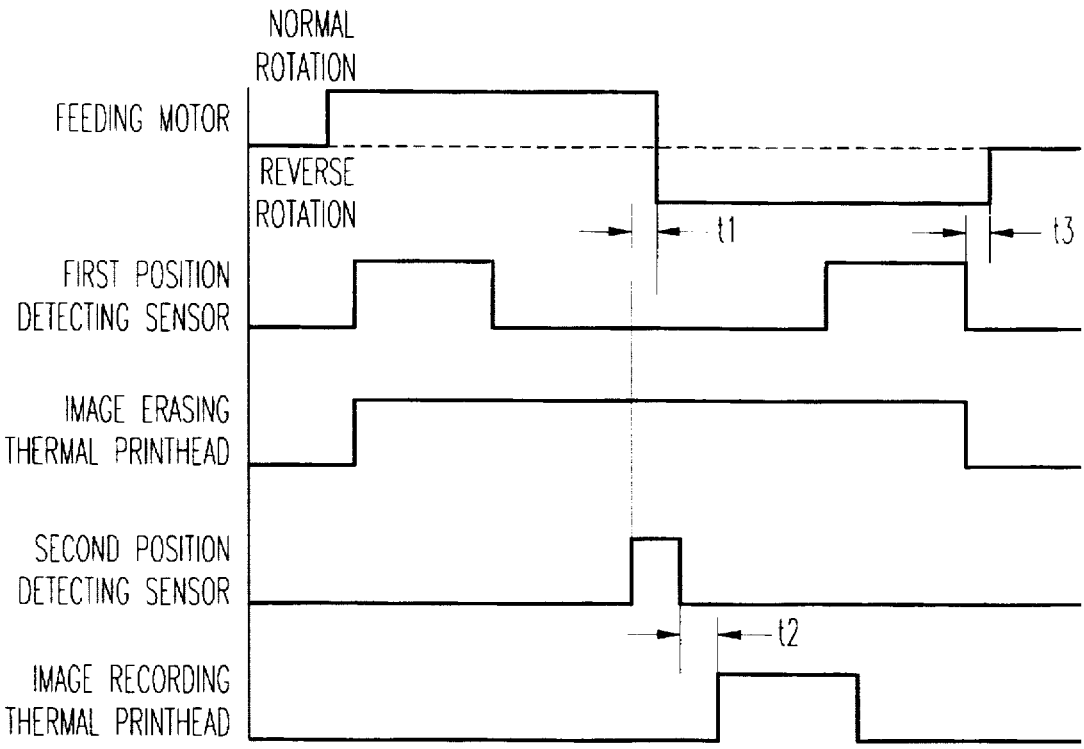
FIG. 7 is a timing chart illustrating operations of the thermal recording and erasing apparatus shown in FIG. 4.

An operation of the above-mentioned recording and erasing apparatus 2 for erasing an image previously recorded on the recording material 1 and recording a new image on the recording material 1 will now be explained with reference to FIGS. 4 and 6 and the timing chart of FIG. 7.

When recording or erasing of an image is directed by the operation indicating device 22 after the card 1*a* is inserted in the card entrance 8, the main controller 21 directs the feed controlling device 25 to feed the card 1*a* along the card feeding path. Then the feed controlling device 25 drives the feeding motor 14 to rotate at a constant speed in a direction that causes the feeding rollers 3*a*, 3*b* and 3*c* to feed the card 1*a* in a forward direction. By the rotation of the feeding motor 14, the feeding rollers 3*a*, 3*b* and 3*c* thus feed the card 1*a* toward the thermal printhead 5, the thermal erasing head 6 and the magnetic head 7 along the card feeding path. When the card 1*a* is fed by feeding roller 3*c* and the tip edge of the card 1*a* is detected by the second position detecting sensor 13, the feed controlling device 25 directs the feeding motor 14 to rotate in a reverse direction after a predetermined time ti from detection of the tip edge of the card 1*a*, as shown in FIG. 7. By the reverse rotation of the feeding rollers 3*a*, 3*b* and 3*c*, the card 1*a* is fed backwards towards the card entrance 8. By moving the card 1*a* back and forth through the feeding path, a previously recorded image on the recording material 1 of the card 1*a* is erased and a new image is recorded, as will now be discussed.

As the card 1*a* is fed in a forward direction by feeding rollers 3*a*, 3*b* and 3*c*, the image erasing head 6 is energized, and as the card 1*a* passes the image erasing head 6 image information on card 1*a* is erased. As previously discussed, when the tip edge of the card 1*a* is detected by second position detection sensor 13 the card 1*a* is fed backwards towards the card entrance 8 after a time $t_1$. In addition, when the card 1*a* passes by the second position detecting sensor 13, the print controlling device 26 directs the thermal printhead 5 to start to record a new image after a constant time $t_2$ which is predetermined depending on a feeding speed of the card 1*a* from a time that the card passes the second position detecting sensor 13. When the first position detecting sensor 12 detects the card 1*a*, i.e., the tip edge of the card 1*a* passes the first position detector 12, after the detection of the card 1*a* by the second position detector 13, a detection signal turns off, and the erasure controlling device 27 cuts off the current which has been applied to the thermal erasing head 6. Then, after a constant time $t_3$ from the end of the detection signal of the card 1*a* by the first position detecting sensor 12, the card 1*a* on which the new image is recorded is fed out from the card entrance 8 by feeding roller 3*a*, the feed controlling device 25 directs the feeding motor 14 to stop, and the operation of erasing the previously recorded image and recording the new image on the recording material 1 is completed.

Figure 8:
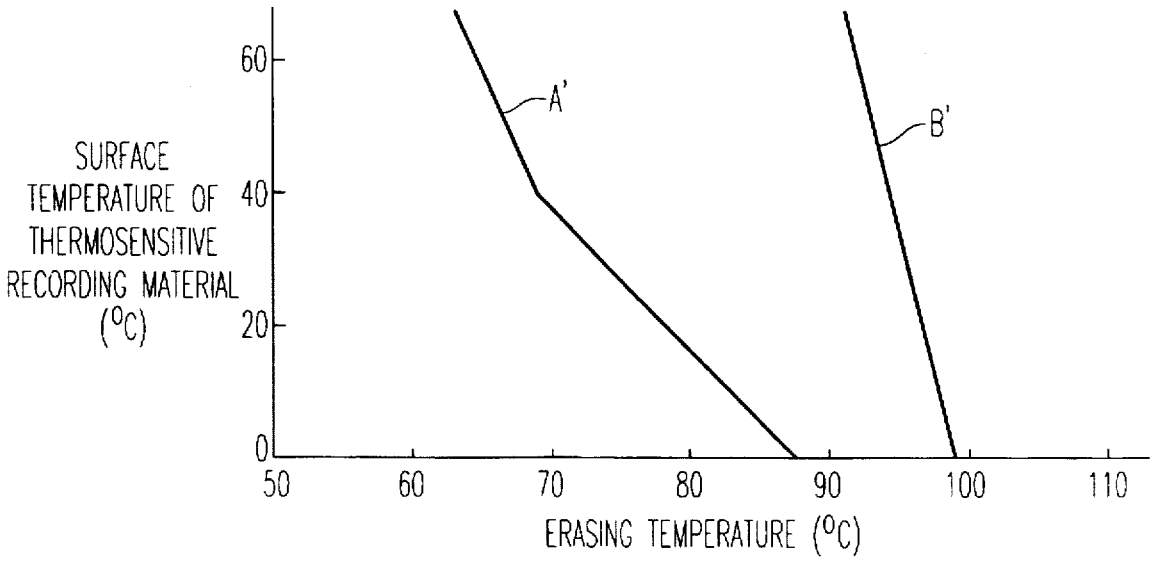
FIG. 8 is a graph showing a relationship between a temperature of a reversible thermosensitive recording material before an erasing operation and a temperature range suitable for erasing an image.

FIG. 8 shows a relationship between a temperature of the recording material 1 before an erasing operation and a temperature range suitable for erasing an image recorded on the recording material 1. The recording material 1 has a thermal characteristic that a previously recorded image can be erased at a temperature in a range from about 75° C. to 90° C. In FIG. 8, a line A' denotes a lower limit temperature for erasing an image and a line B' denotes an upper limit temperature for erasing the image. As shown in FIG. 8, although a temperature range for erasing an image on the recording material 1 is from about 75° C. to 90° C. When a temperature of the recording material 1 is at about 25° C., the temperature range for erasing an image in the recording material is from about 85° C. to 95° C. When a temperature of the recording material 1 is at about 5° C. On the other hand, when a temperature of the recording material 1 is at about 45° C., the temperature range for erasing an image in the recording material 1 is from about 67° C. to 88° C. Therefore, heat quantity to be applied to the recording material 1 by the resistant heater 10 of the thermal erasing head 6 has to be changed depending on the temperature of the recording material 1.

Figure 9:
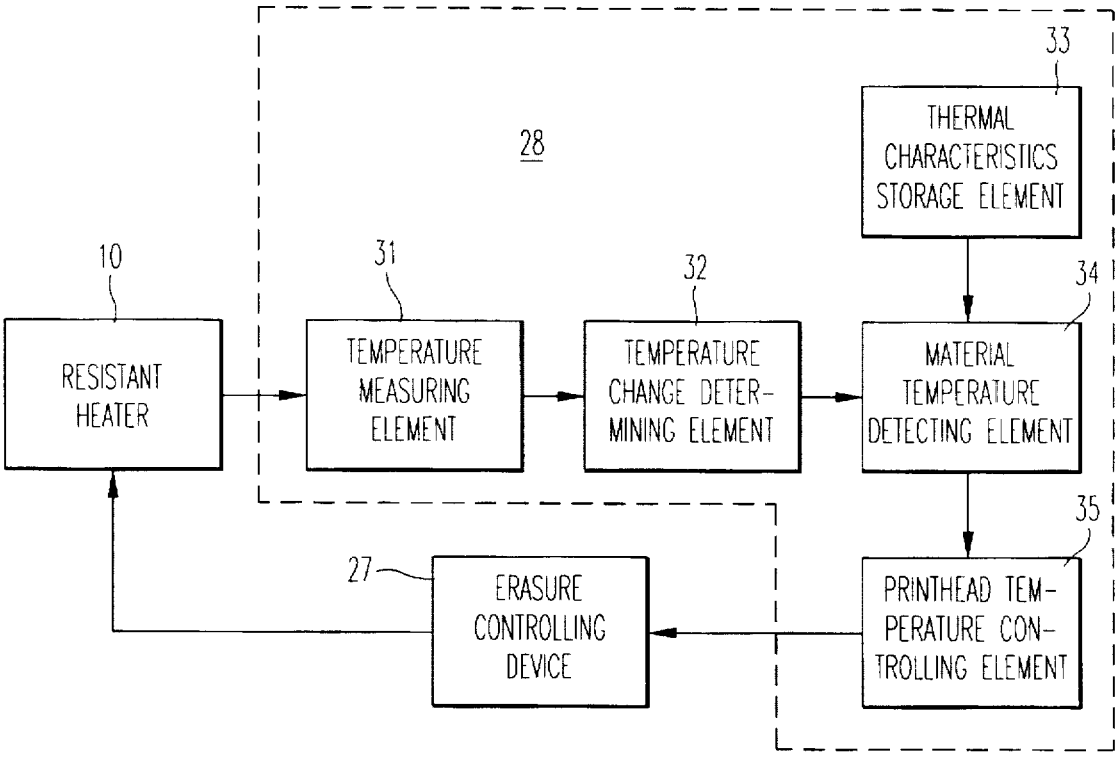
FIG. 9 is a block diagram illustrating a temperature setting unit according to the present invention.

The temperature setting device 28 which sets a heating temperature of the resistant heater 10 of the thermal erasing head 6 includes, as shown in FIG. 9, a temperature measuring element 31 for measuring a temperature of the resistant heater 10, a temperature change determining element 32 for detecting a temperature change of the resistant heater 10, a thermal characteristics storage element 33 for storing thermal characteristics of the resistant heater 10, a material temperature detecting element 34 for detecting a temperature of the recording material 1, and a printhead temperature controlling element 35 for controlling a temperature of the thermal erasing head 6.

The temperature measuring element 31 measures a temperature of the resistant heater 10 by a temperature measuring device such as, for example, a thermistor provided in close proximity of the resistant heater 10 or by measuring a change of resistance of the resistant heater 10. In the preferred embodiment, the method of measuring a temperature of the heater 10 using a change of resistance of the resistant heater 10 is used because this method has high sensitivity and can directly detect a temperature of the resistant heater 10.

Figure 10:
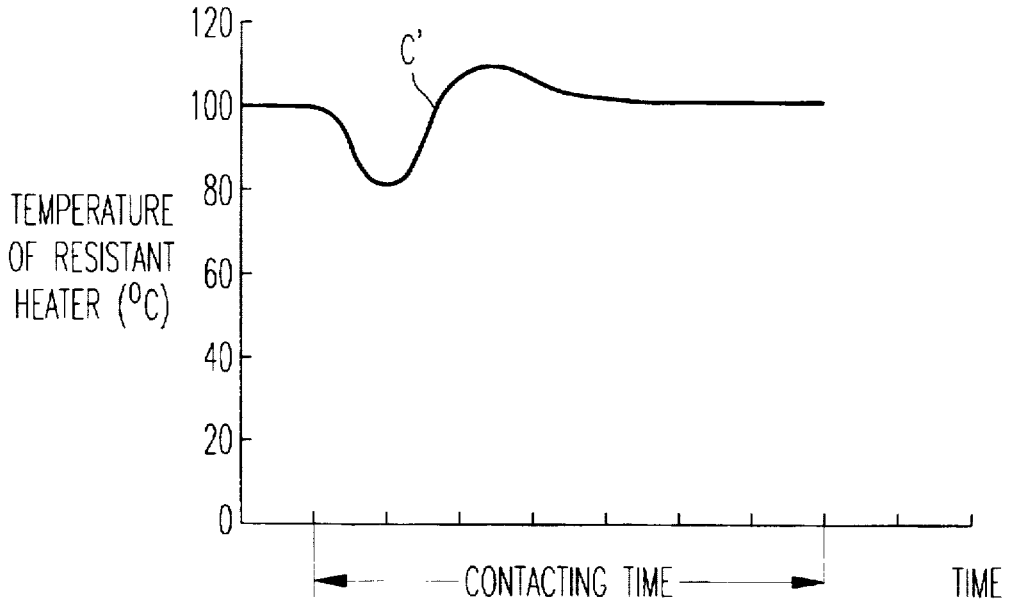
FIG. 10 is a graph showing a temperature change of a resistant heater of a thermal printhead when a surface of the resistant heater of the thermal printhead contacts a surface of a thermosensitive recording material.

The temperature change detecting element 32 determines a temperature change of the resistant heater 10 as a function of a measured temperature of the resistant heater 10. The thermal characteristics storage element 33 stores thermal characteristics of the resistant heater 10 which is a predefined relationship between a temperature of the recording material 1 and a temperature change of the resistant heater 10 at a time when a surface of the resistant heater 10 of the thermal erasing head 6 contacts a surface of the recording material 1. In more detail, a temperature of the resistant heater 10 is controlled, for example, to about 100° C. by controlling a current applied to the resistant heater 10 by proportional pulse control while measuring resistance of the resistant heater 10 to measure a temperature of the resistant heater 10. When the recording material 1 at about 25° C. is contacted with the thermal erasure head 6, a temperature of the resistant heater 10 is shown by a curve C' in FIG. 10 and a maximum temperature drop of the heater 10 is about 20° C. (100° C.–80° C.)

Figure 11:
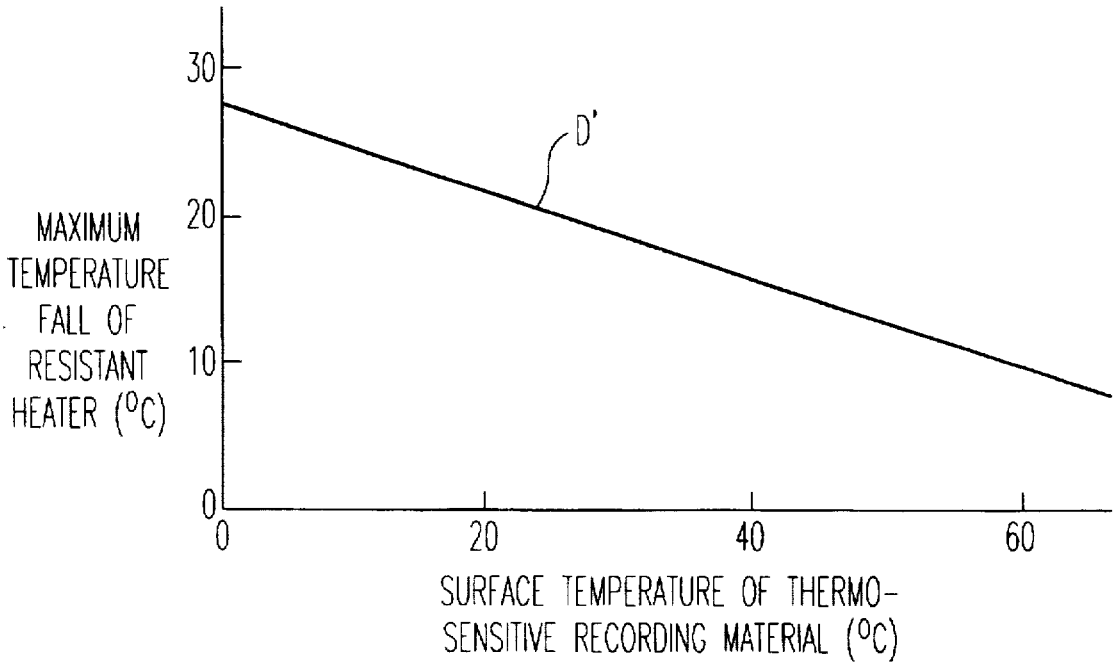
FIG. 11 is a graph showing a relationship between a temperature of a thermosensitive recording material and a temperature drop of a resistant heater of a thermal printhead according to the present invention.

FIG. 11 shows a relationship between a temperature of the recording material 1 and a maximum temperature drop of the resistant heater 10 during contact of a surface of the resistant heater 10 of the thermal erasing head 6 with the recording material 1. As shown by a line D' in FIG. 11, when temperatures of the recording material 1 is between about 0° C. and 60° C., corresponding maximum temperature drops are about 28° C. and 10° C., respectively, while a maximum temperature drop is about 20° C. When a temperature of the recording material 1 is at about 25° C. (room temperature). In other words, a maximum temperature drop of the resistant heater 10 can be approximately expressed by a linear equation of a temperature of the recording material 1. Therefore, a temperature of the recording material 1 can be determined based upon a maximum temperature drop of the resistant heater 10. A relationship between a temperature of the recording material 1 and a maximum temperature drop of the resistant heater 10, as shown, for example, in FIG. 11, may be previously measured and stored in the thermal characteristics storage element 33, and a relationship between a heating temperature of the resistant heater 10 suitable for erasing an image and a temperature of the recording material 1 before an erasing operation, as shown, for example, in FIG. 8, may also be previously stored in the thermal characteristics storage element 33.

The material temperature detecting element 34 reads a maximum temperature drop from a temperature changing curve of the resistant heater 10 detected by the temperature change detecting element 32 when the recording material 1 contacts a surface of the resistant heater of the thermal erasing head 6 and thus determines a temperature of the recording material 1.

The printhead temperature controlling element 35 sets a heating temperature of the resistant heater 10 in the thermal erasing head 6 to a temperature suitable for erasing as a function of determined temperature of the recording material 1.

Next, an image erasing and recording process is described in detail. In the above-mentioned recording and erasing apparatus 2, after card 1*a* is fed forward by rollers 3*a*, 3*b* and 3*c* in order to erase a previously recorded image and record a new image on the recording material 1, a current is applied to the resistant heater 10 in the thermal erasing head 6 as previously discussed, and the temperature measuring element 31 successively measures a temperature of the resistant heater 10 and sends the data to the temperature change determining element 32. The temperature change determining element 32 successively stores the received data to determine a temperature change of the resistant heater 10. The material temperature detecting element 34 reads a maximum temperature drop which occurs during the contact of the thermal erasing head 6 with the tip edge of the card 1*a* from the temperature change data stored in temperature change determining element 32. Then the material temperature detecting element 34 determines a temperature of the card 1*a*, i.e., a temperature of the recording material 1 before an erasing operation as a function of the predefined relationship between a temperature of the recording material 1 and a maximum temperature drop of the resistant heater 10 stored in the thermal characteristics storage element 33, and sends the data of the temperature of the recording material 1 to the printhead temperature controlling element 35. The printhead temperature controlling element 35 determines an erasing temperature of the resistant heater 10 suitable for erasing an image as a function of the predefined relationship between a temperature of the resistant heater 10 for erasing an image and a temperature of the recording material 1 before an erasing operation, which is stored in the thermal characteristics storage element 33, and sends the data of the heating temperature of the resistant heater 10 to the erasure controlling device 27. The erasure controlling device 27 applies a pulse current to the resistant heater 10 so that a temperature of the resistant heater 10 reaches the heating temperature sent by the temperature controlling element 35 and the previously recorded image in the recording material 1 is erased.

As mentioned above, since a previously printed image on the recording material 1 is erased by the most suitable temperature of the resistant heater 10 depending on a temperature of the recording material 1, an image is erased without residue of the previously recorded image.

When a new image is recorded in the recording material 1 after an image erasing operation, the recording material 1 has almost a constant temperature because of the application of heat from the image erasing operation, so that a new image can be repeatedly recorded on the recording material 1 without changing recording conditions.

The above-mentioned image erasing and recording method is performed by one pass in which a previously recorded image is erased and a new image is recorded on the recording material 1 after a temperature of a recording material 1 of a card 1*a* is detected. However, another method is possible in which the above-mentioned image erasing and performed in operation is performed in two passes. For example, as a first pass, detection of a temperature of the recording material 1 and setting of a suitable temperature of the resistant heater 10 is performed, and then, as a second pass, the card 1*a* is fed and a previously recorded image is erased and a new image is recorded on the recording material 1.

Figure 1:
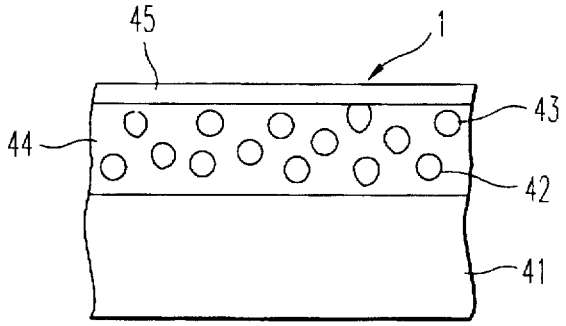
FIG. 1 is a sectional view of a reversible thermosensitive recording material.
Figure 2:
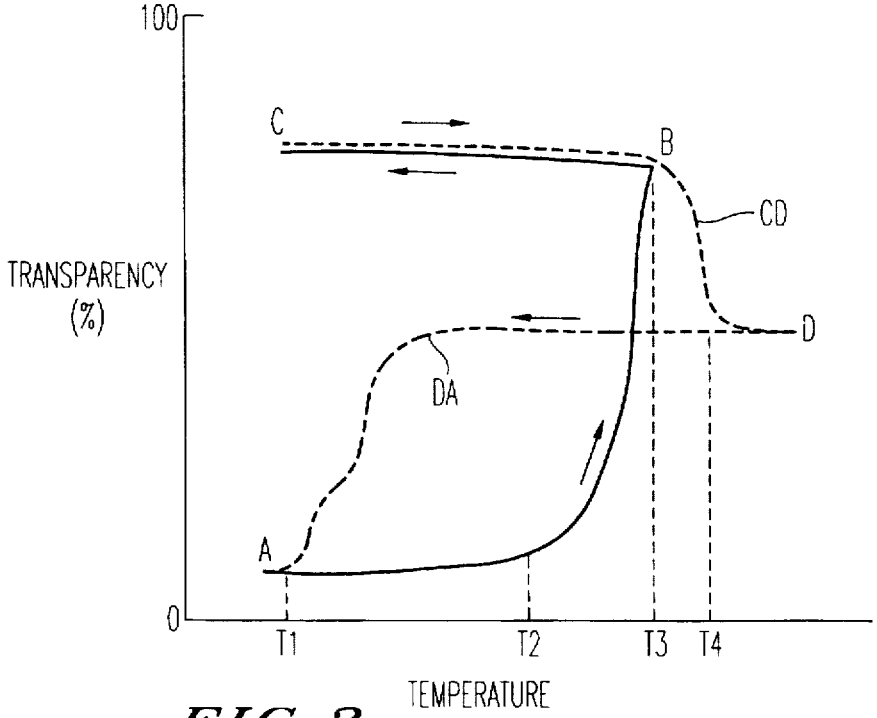
FIG. 2 is a graph showing a relationship between a temperature and transparency of a reversible thermosensitive recording material in an image recording and erasing cycle of a reversible thermosensitive recording material.
Figure 3:
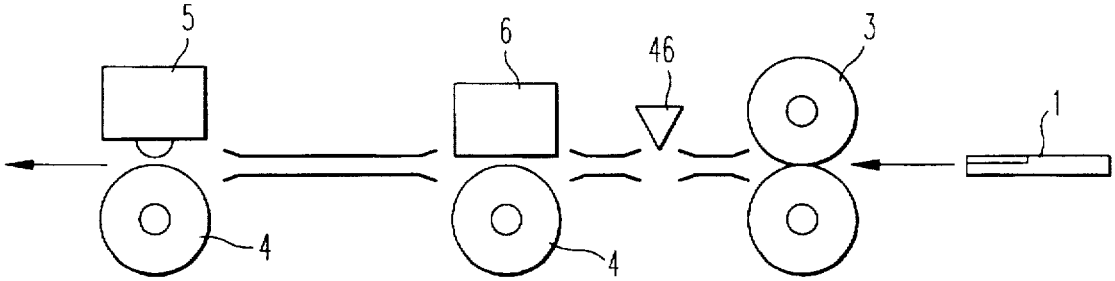
FIG. 3 is a schematic diagram of a background embodiment of a thermal recording apparatus.

In addition, although the above-mentioned method is applied to an apparatus in which the card 1*a* is fed back and forth, the above-mentioned operation may be also applied to an apparatus which has an one-way card feeding path, for example, as shown in FIG. 3, for an image erasing and an image recording operation.

In another embodiment of the present invention, a temperature controlling method for a thermal printhead is provided which includes:

(1) bringing a surface of a resistant heater 10 of a thermal erasing head 6 into contact with a surface of a thermosensitive recording material 1;

(2) applying a current generating a constant heat quantity to the resistant heater 10 of the thermal erasing head 6;

(3) measuring a temperature change of the resistant heater 10;

(4) determining a temperature of the recording material 1 as a function of a predefined relationship between a temperature of the recording material 1 and the temperature change of the resistant heater 10; and (5) determining a heating temperature of the resistant heater 10 of the thermal erasing head 6 as a function of the temperature of the thermosensitive recording material 1; and (6) then applying a current to the resistant heater 10 to heat the resistant heater 10 to the heating temperature suitable for erasing an image in the recording material 1 as a function of the detected temperature of the recording material 1.

In the above method, a temperature of the recording material 1 is detected by measuring a temperature change, for example, a rising gradient of a temperature of the resistant heater 10 at a time when a constant current is applied to the resistant heater 10 of the thermal erasing head 6. In more detail, when a temperature of the recording material 1 is relatively low, a rising gradient of a temperature of the resistant heater 10 is gradual as compared to a rising gradient of a temperature of the resistant heater 10 which is sharp when a temperature of the recording material 1 is relatively high. A temperature of the recording material 1 is determined as a function of a predefined relationship between a temperature of the recording material 1 and a rising gradient of the temperature of the resistant heater 10.

In the above-mentioned embodiments, the temperature controlling methods and apparatus according to the present invention are applied to a case where the card 1*a* including the reversible thermal recording material 1 is subjected to an image erasing operation and then subjected to an image recording operation. However, the temperature controlling methods and apparatus according to the present invention are also applicable to all types of recording apparatus which do not have an image erasing function and record image information on conventional thermosensitive recording materials such as, for example, a thermosensitive recording paper which includes a substrate such as paper and film and a thermosensitive recording layer formed on the substrate and including a leuco dye, and a thermal transfer recording material in which an inked ribbon is heated to transfer ink to an image receiving material, as will be apparent to those skilled in the electronic arts.

In addition, in the above-mentioned embodiments, heat quantity applied to the recording material 1 in the card 1*a* for erasing an image is changed depending on a temperature of the recording material 1 before an erasing operation while a feeding speed of the card 1*a* is constant. However, a feeding speed of the card 1*a* may be changed or an erasing operation may be repeated two or more times while changing a current to the resistant heater 10 in order to apply suitable heat to the recording material 1 for sure erasure of the image. As shown in FIG. 8, the lower a temperature of the recording material 1 becomes, the narrower an area between the line A' and the line B' becomes, i.e., the narrower an temperature range for erasing an image becomes. For example, when the temperature of the recording material 1 becomes below about 0° C., a temperature range for erasing an image becomes less than about 10° C. In addition, in case of using a reversible thermosensitive recording material 1 having a characteristic of a relatively narrow temperature range for erasing an image, a temperature range for erasing an image becomes much narrower than the area shown in FIG. 8. Even when a temperature range for erasing an image is relatively narrow, an image is erased using the above-mentioned methods in which a feeding speed is changed or an image erasing operation is repeated two or more times while changing a current to the resistant heater 10.

In the above-mentioned method, an image erasing operation which is particularly effective for a case in which a response time of the temperature measuring element 31 is too long to measure a temperature of the resistant heater 10 before an image erasing operation will now be described. In this case, a heating temperature of the resistant heater 10 does not have to be changed in a first image erasing operation and the temperature measuring operation of the resistant heater 10 is continued. After the first image erasing operation, a decision is made as to whether a second image erasing operation is needed or not. If a second image erasing operation is needed, a heating temperature of the resistant heater 10 is determined so as to erase a residual image as a function of the temperature of the resistant heater 10 which is pre-heated by the first image erasing operation.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United Sates is:

1. A temperature controlling method for one or more thermal printheads used for recording or erasing an image on a thermosensitive recording material, comprising the steps of:

heating a resistant heater of one thermal printhead of said one or more thermal printheads to a constant temperature by applying a current to said resistant heater of said one thermal printhead;

measuring a temperature change of said resistant heater of said one thermal printhead when a surface of said resistant heater of said one thermal printhead contacts a surface of said thermosensitive recording material;

determining a temperature of said thermosensitive recording material based on a predetermined relationship between the temperature of said thermosensitive recording material and the temperature change of said resistant heater of said one thermal printhead;

determining a heating temperature of said resistant heater of said one thermal printhead or each heating temperature of each resistant heater of said thermal printheads based on the temperature of said thermosensitive recording material; and applying a current, to said resistant heater of said one thermal printhead or a current to each resistant heater of said thermal printheads, for recording or erasing an image on the thermosensitive recording.

2. The temperature controlling method of claim 1, wherein said step of measuring a temperature change of said resistant heater comprises the steps of:

determining the temperature change of said resistant heater based on a maximum temperature drop of said resistant heater after the time when the surface of said resistant heater contacts said thermosensitive recording material.

3. The temperature controlling method of claim 1, wherein said step of measuring the temperature change of said resistant heater comprises the steps of:

determining the temperature change of said resistant heater based on a temperature rising gradient from a minimum point of the temperature of said resistant heater after the contact of said thermosensitive recording material with the surface of said resistant heater.

4. The temperature controlling method of claim 1, wherein said step of measuring the temperature change of said resistant heater comprises the steps of:

determining the temperature change of said resistant heater based on a temperature falling gradient from the time when the surface of said resistant heater contacts said thermosensitive recording material.

5. The temperature controlling method of claim 1, wherein said step of measuring the temperature change of said resistant heater comprises the steps of:

determining the temperature change of said resistant heater in a period from the time when the surface of said resistant heater contacts said thermosensitive recording material to a time when a temperature of said resistant heater returns to said constant temperature of said resistant heater.

6. A temperature controlling method for one or more thermal printheads used for recording or erasing an image on a thermosensitive recording material, comprising the steps of:

heating a resistant heater of one thermal printhead of said one or more thermal printheads to a constant temperature by applying a current to said resistant heater of said one thermal printhead;

measuring a temperature change of said resistant heater of said one thermal printhead at a time when a surface of said resistant heater of said one thermal printhead for a constant time contacts a surface of said thermosensitive recording material;

determining a temperature of said thermosensitive recording material based on a predetermined relationship between the temperature of said thermosensitive recording material and the temperature change of said resistant heater of said one thermal printhead;

determining a heating temperature of said resistant heater of said one thermal printhead or each heating temperature of each resistant heater of said thermal printheads based on the temperature of said thermosensitive recording material; and applying a current, to said resistant heater of said one thermal printhead or a current to each resistant heater of said thermal printheads, for recording or erasing an image on the thermosensitive recording material.

7. The temperature controlling method of claim 6, wherein said step of measuring the temperature change of said resistant heater comprises the steps of:

determining the temperature change of said resistant heater based on a temperature drop of said resistant heater.

8. The temperature controlling method of claim 6, wherein said step of measuring the temperature change of said resistant heater comprises the steps of:

determining the temperature change of said resistant heater based on a temperature falling gradient from the time when the surface of said resistant heater contacts said thermosensitive recording material.

9. A temperature controlling method for one or more thermal printheads used for recording or erasing an image on a thermosensitive recording material, comprising the steps of:

bringing a surface of a resistant heater of one thermal printhead of said one or more thermal printheads into contact with a surface of said thermosensitive recording material;

applying a current to said resistant heater of said one thermal printhead so that said resistant heater generates a constant heat quantity;

measuring a temperature change of said resistant heater of said one thermal printhead;

determining a temperature of said thermosensitive recording material based on a predetermined relationship between the temperature of said thermosensitive recording material and the temperature change of said resistant heater of said one thermal printhead;

determining a heating temperature of said resistant heater of said one thermal printhead or each heating temperature of each resistant heater of said thermal printheads based on the temperature of said thermosensitive recording material; and applying a current, to said resistant heater of said one thermal printhead or a current to each resistant heater of said thermal printheads, for recording or erasing an image on the thermosensitive recording material.

10. The temperature controlling method of claim 9, wherein said step of measuring the temperature change of said resistant heater comprises the steps of:

determining the temperature change of said resistant heater based on a temperature rising gradient of said resistant heater.

11. The temperature controlling method of claim 9, wherein said step of measuring the temperature change of said resistant heater comprises the steps of:

determining the temperature change of said resistant heater based on a temperature rise of said resistant heater for a constant time.

12. A temperature controlling apparatus for a thermal printhead having a resistant heater used for recording or erasing an image on a thermosensitive recording material, comprising:

a printhead temperature measuring element which measures a current temperature of said resistant heater of said thermal printhead;

a temperature change determining element coupled to said printhead temperature measuring element and which determines a temperature change of said resistant heater of said thermal printhead;

a thermal characteristics storage element which stores a first predetermined relationship between a temperature of said thermosensitive recording material and the temperature change of said resistant heater of said thermal printhead at a time when a surface of said resistant heater of said thermal printhead contacts a surface of said thermosensitive recording material, and stores a second predetermined relationship between the temperature of said thermosensitive recording material and a heating temperature, of said resistant heater of said thermal printhead, for recording or erasing said image on said thermosensitive recording material;

a material temperature detecting element coupled to said thermal characteristics storage element and said temperature change determining element and which detects the temperature of said thermosensitive recording material based on the first predetermined relationship stored in said thermal characteristics storage element; and a printhead temperature controlling element coupled to said material temperature detecting element and which sets a temperature of said resistant heater of said thermal printhead to a heating temperature based on the second predetermined relationship stored in said thermal characteristics storage element.

13. The temperature controlling apparatus of claim 12, wherein said printhead temperature measuring element determines the temperature of said resistant heater of said thermal printhead by measuring a resistance of said resistant heater.

14. The temperature controlling apparatus of claim 12, wherein said temperature change determining element detects the temperature change of said resistant heater based on a maximum temperature drop of said resistant heater after the time when the surface of said resistant heater contacts said thermosensitive recording material.

15. The temperature controlling apparatus of claim 12, wherein said temperature change determining element detects the temperature change of said resistant heater based on a temperature rising gradient from a minimum point of the temperature of said resistant heater after the time when the surface of said resistant heater contacts said thermosensitive recording material.

16. The temperature controlling apparatus of claim 12, wherein said temperature change determining element detects the temperature change of said resistant heater based on a temperature falling gradient from the time when the surface of said resistant heater contacts said thermosensitive recording material.

17. The temperature controlling apparatus of claim 12, wherein said temperature change determining element detects the temperature change of said resistant heater in a period from the time when the surface of said resistant heater contacts said thermosensitive recording material to a time when the temperature of said resistant heater returns to a constant temperature.

18. The temperature controlling apparatus of claim 12, wherein said temperature change determining element detects the temperature change of said resistant heater based on a temperature drop of said resistant heater for a constant time.

19. The temperature controlling apparatus of claim 12, wherein said temperature change determining element detects the temperature change of said resistant heater based on a temperature rise of said resistant heater for a constant time.

20. A temperature controlling apparatus for a thermal printhead having a resistant heater used for recording or erasing an image on a thermosensitive recording material, comprising:

a printhead temperature measuring means which measures a current temperature of said resistant heater of said thermal printhead;

a temperature change determining means coupled to said printhead temperature measuring means and which determines a temperature change of said resistant heater of said thermal printhead;

a thermal characteristics storage means which stores a first predetermined relationship between a temperature of said thermosensitive recording material and the temperature change of said resistant heater of said thermal printhead at a time when a surface of said resistant heater of said thermal printhead contacts a surface of said thermosensitive recording material, and stores a second predetermined relationship between the temperature of said thermosensitive recording material and a heating temperature, of said resistant heater of said thermal printhead, for recording or erasing said image on said thermosensitive recording material;

a material temperature detecting means coupled to said thermal characteristics storage means and said temperature change determining means and which detects the temperature of said thermosensitive recording material based on the first predetermined relationship stored in said thermal characteristics storage means; and a printhead temperature controlling means coupled to said material temperature detecting means and which sets a temperature of said resistant heater of said thermal printhead to a heating temperature based on the second predetermined relationship stored in said thermal characteristics storage means.

21. The temperature controlling apparatus of claim 20, wherein said temperature change determining means detects the temperature change of said resistant heater based on a maximum temperature drop of said resistant heater after the time when the surface of said resistant heater contacts said thermosensitive recording material.

22. The temperature controlling apparatus of claim 20, wherein said temperature change determining means detects the temperature change of said resistant heater based on a temperature rising gradient from a minimum point of the temperature of said resistant heater after the time when the surface of said resistant heater contacts said thermosensitive recording material.

23. The temperature controlling apparatus of claim 20, wherein said temperature change determining means detects the temperature change of said resistant heater based on a temperature falling gradient from the time when the surface of said resistant heater contacts said thermosensitive recording material.

24. The temperature controlling apparatus of claim 20, wherein said temperature change determining means detects the temperature change of said resistant heater in a period from the time when the surface of said resistant heater contacts said thermosensitive recording material to a time when the temperature of said resistant heater returns to said constant temperature of said resistant heater.

25. The temperature controlling apparatus of claim 20, wherein said temperature change determining means detects the temperature change of said resistant heater based on a temperature drop of said resistant heater for a constant time.

26. The temperature controlling apparatus of claim 20, wherein said temperature change determining means detects the temperature change of said resistant heater based on a temperature rise of said resistant heater for a constant time.

27. The temperature controlling apparatus of claim 20, wherein said printhead temperature measuring means determines the temperature of said resistant heater of said thermal printhead by measuring a resistance of said resistant heater.

28. An apparatus for recording or erasing an image on a card having thermosensitive recording material, comprising:

a thermal printhead having a resistant heater which records or erases said image on said thermosensitive recording material; and a temperature controlling device which controls said thermal printhead, including, a printhead temperature measuring element which measures a current temperature of said resistant heater of said thermal printhead, a temperature change determining element coupled to said printhead temperature measuring element and which determines a temperature change of said resistant heater of said thermal printhead, a thermal characteristics storage element which stores a first predetermined relationship between a temperature of said thermosensitive recording material and the temperature change of said resistant heater of said thermal printhead at a time when a surface of said resistant heater of said thermal printhead contacts a surface of said thermosensitive recording material, and stores a second predetermined relationship between the temperature of said thermosensitive recording material and a heating temperature, of said resistant heater of said thermal printhead, for recording or erasing an image on said thermosensitive recording material, a material temperature detecting element coupled to said thermal characteristics storage element and said temperature change determining element and which detects the temperature of said thermosensitive recording material based on the first predetermined relationship stored in said thermal characteristics storage element, and a printhead temperature controlling element coupled to said material temperature detecting element and which sets a temperature of said resistant heater of said thermal printhead to a heating temperature based on the second predetermined relationship stored in said thermal characteristics storage element.

29. The apparatus of claim 28, further comprising:

a magnetic head element which reads magnetic information stored on said card having said thermosensitive recording material;

at least one feeding element which feeds said card to said thermal printhead; and a motor element which drives said feeding element for feeding said card to said thermal printhead.

* * * * *